United States Patent [19]

Baginski et al.

[11] Patent Number: 4,958,135

[45] Date of Patent: Sep. 18, 1990

[54] HIGH RATING MOLDED CASE MULTIPOLE CIRCUIT BREAKER

[75] Inventors: Pierre Baginski, Grenoble; Jean-Pierre Nebon, St. Martin le Vinoux; Marc Bur, Grenoble, all of France

[73] Assignee: Merlin Gerin, France

[21] Appl. No.: 279,456

[22] Filed: Dec. 5, 1988

[30] Foreign Application Priority Data

Dec. 10, 1987 [FR] France ..... 87 17446

[51] Int. Cl.[5] ..... H01H 75/00

[52] U.S. Cl. ..... 335/8; 361/376

[58] Field of Search ..... 361/331, 347, 350, 351, 361/353, 354, 355, 360, 361, 363, 376, 396; 335/8–10

[56] References Cited

U.S. PATENT DOCUMENTS 3,289,049 11/1966 Middendorf ..... 361/376
3,879,100 4/1975 Chabot .
4,764,650 8/1988 Bur et al. ..... 200/144 C

FOREIGN PATENT DOCUMENTS 0117094 8/1984 European Pat. Off. .

*Primary Examiner*—Leo P. Picard
*Assistant Examiner*—Lincoln Donovan
*Attorney, Agent, or Firm*—Arnold, White & Durkee

[57] ABSTRACT

A high-current multipole circuit breaker is made up of standard poles juxtaposed in a molded case. At least two adjacent poles are twinned, that is to say electrically arranged in parallel and connected to a common connecting strip. The connecting strips of the other poles are widened, so as to partially overlap the immediately adjacent twinned pole. In this way, the circuit breaker rating is higher than that of the individual poles which make it up.

10 Claims, 7 Drawing Sheets

HIGH RATING MOLDED CASE MULTIPOLE CIRCUIT BREAKER

BACKGROUND OF THE INVENTION

The invention relates to a low-voltage multiple circuit breaker, for high current intensities, comprising a plurality of poles juxtaposed inside an insulating molded case, each pole comprising a pair of separable contacts, an arc chute, a pair of contact terminal pads connected to the separable contacts and protruding outwards from the case, and a current transformer disposed around one of the contact terminal pads and whose output is connected to a trip device common to the different poles, the contact terminal pads being connected to connecting strips designed to be connected respectively to the phases of a mains system to be protected.

The rating of a circuit breaker of this type is, for a case of a predetermined size, determined by the choice of poles, that is to say essentially by the dimensions of the copper parts associated with the pole.

SUMMARY OF THE INVENTION

The object of the invention is to widen a range of circuit breakers comprising a certain number of standard poles, so as to form, in a standard molded case, a circuit breaker with a higher rating than that of the individual standard poles which make it up, this object being accomplished with a minimum number of modifications.

The circuit breaker according to the invention is characterized in that at least one of the connecting strips, designed to be connected to one of the mains phases, is connected to at least two adjacent twinned poles, electrically arranged in parallel, at least one of the connecting strips associated with another pole of the circuit breaker having a width such that it extends laterally beyond said pole and partially overlaps the immediately adjacent pole, so that the circuit breaker can be used for a higher rating than that of the individual standard poles which make it up.

According to a preferred embodiment, the connecting strips extending laterally beyond the associated pole have a flared shape, their smallest face being in contact with the rear face of the associated contact terminal pad and the connecting strip associated with the twinned poles only covers a part of the associated contact terminal pads, an insulating shield being fitted on the free part of the contact terminal pads of the twinned poles in such a way as to provide insulation between said terminal pads and the adjacent connecting strips.

If the circuit breaker is of the draw-in type in a fixed frame supporting fixed connection terminal pads designed to be connected by means of connecting grips to the circuit breaker connecting strips, the width of the fixed terminal pads and of the connecting grips is appreciably equal to that of the corresponding strip, so as to form connecting zones at least one of which is wider than the associated pole and at least one of which, associated with the twinned poles, has a smaller width than the previously mentioned one.

BRIEF DESCRIPTION OF THE DRAWINGS

Other advantages and features will become more clearly apparent from the following description of various illustrative embodiments of the invention, given as non-restrictive examples only and represented in the accompanying drawings, in which.

DESCRIPTION OF THE PREFERRED EMBODIMENT

Figure 1:
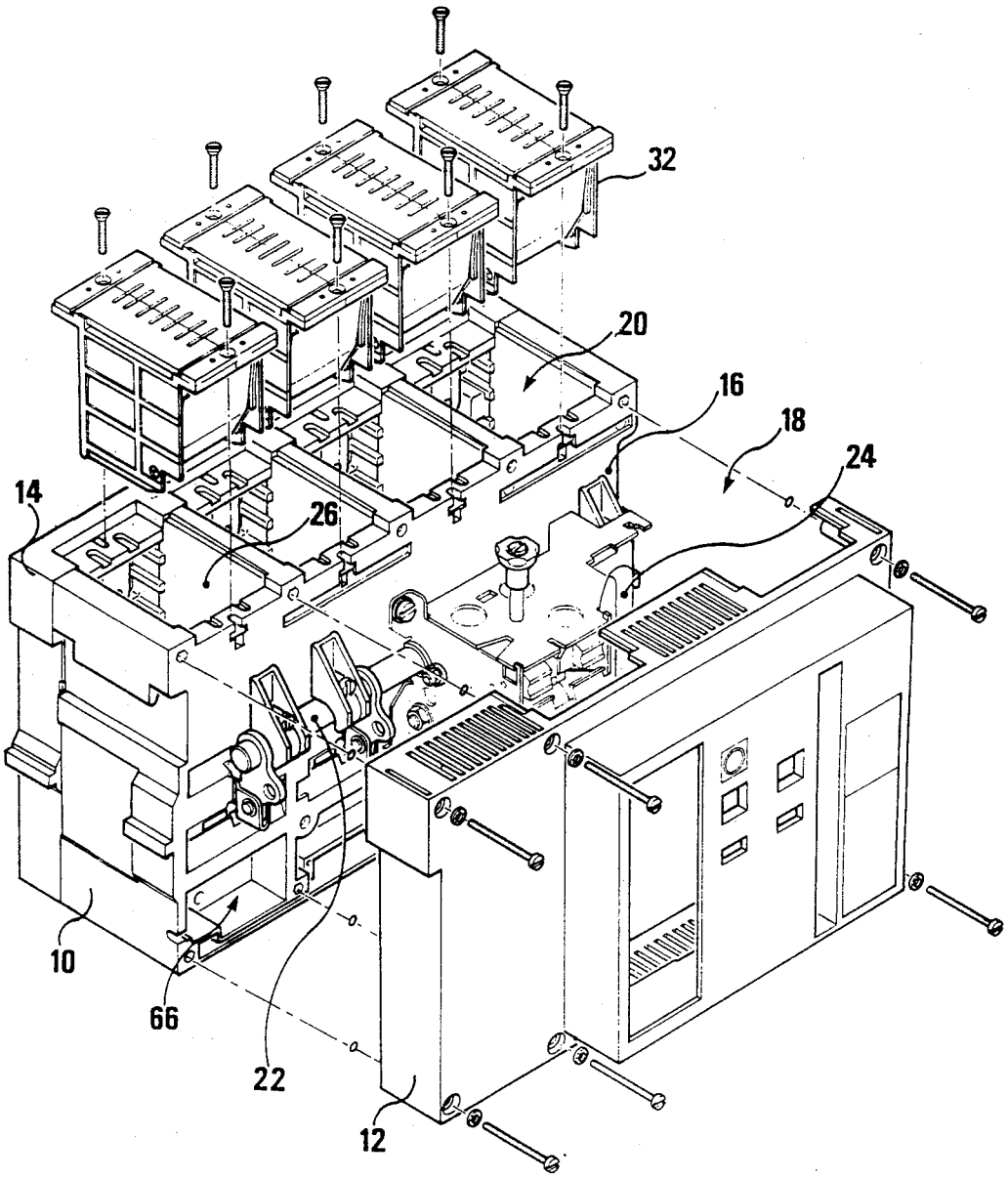
FIG. 1 is an exploded perspective view of a multipole circuit breaker, of a state-of-the-art type.
Figure 2:
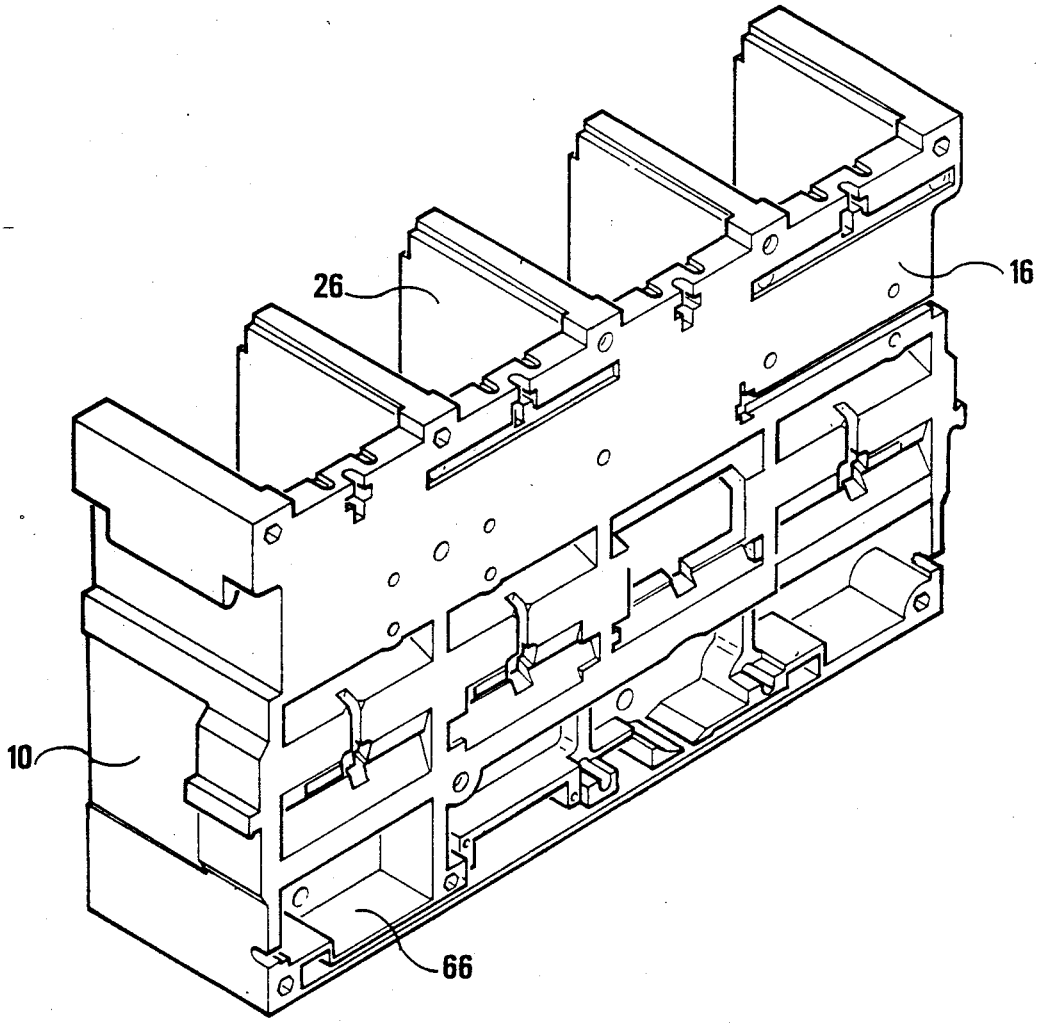
FIG. 2 is a perspective view of the intermediate case of the circuit breaker according to FIG. 1.
Figure 3:
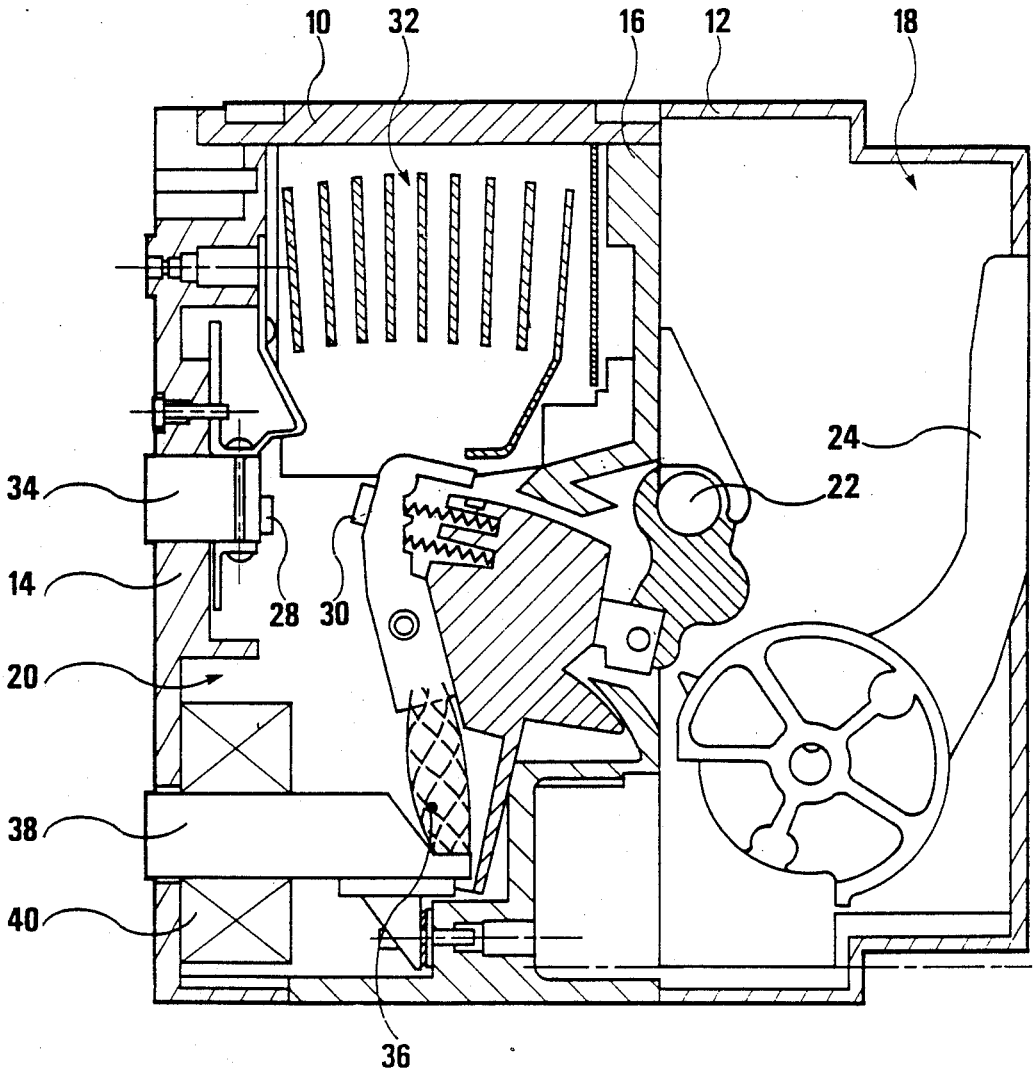
FIG. 3 is a longitudinal sectional view of a pole of the circuit breaker according to FIG. 1, represented in the open contacts position.

In FIGS. 1 to 3, a low-voltage multipole circuit breaker, of a state-of-the-art type, comprises a plurality of poles juxtaposed inside a molded case made of insulating material. The parallelipipedic case is formed by assembling an intermediate case 10 (FIG. 2), a cover 12 and a rear case 14. The front face 16 of the intermediate case 10 divides the case into a front compartment 18, bounded by this face and by the cover 12, and a rear compartment 20 designed to house the poles and electrically insulated from the front compartment.

The front compartment 18 houses an operating mechanism (not shown) acting on a transverse switching bar 22, common to all the poles. An operating mechanism setting lever 24, an electronic trip device (not shown) bringing about automatic tripping when a fault currrent occurs, and electrical measuring, signalling and monitoring auxiliaries (not shown) are also housed in the front compartment 18.

The rear compartment 20 is longitudinally subdivided into elementary compartments housing the poles by insulating partitions 26 separating the poles. Each pole of the rear compartment comprises a pair of separable contacts 28, 30 and a removable arc chute 32. The stationary contact 28 is directly supported by a first contact terminal pad 34 protruding slightly outwards from rear face of the rear case 14. The movable contact 30 is connected by a flexible conductor (braided) to a second contact terminal pad 38, also protruding outwards from the rear face of the rear case 14. A current transformer 40 is disposed around one of the contact terminal pads, in such a way as to supply the trip device with a measurement of the current flowing through the corresponding pole.

The internal arrangement and operation of a circuit breaker of this kind is well-known in the art and U.S. Pat. No. 4,764,650 should be advantageously referred to for a more detailed description.

A circuit breaker of this kind is preferably designed so as to be withdrawable, that is to say designed to be drawn into a fixed frame 42 (FIG. 4) having, on its rear face, two superposed rows of fixed connecting terminal pads 44 designed to be connected respectively to the two superposed rows of contact terminal pads 34, 38 by means of connecting grips 46 each formed by a plurality of juxtaposed elementary contact fingers 48. U.S. Pat. Nos. 4,686,334 and 4,743,715 respectively describe specific embodiments of connecting grips and of a draw-in and withdrawal mechanism of a draw-out circuit breaker of this type.

A range of state-of-the-art circuit breakers of this type comprises two standard, three and four-pole, molded case models, whose rating, from 800A to 3200A, is determined by the choice of the poles housed in the elementary compartments, that is to say essentially by the dimensions of the contact terminal pads 34, 38 securedly fixed to the case, of the grips 46 and of the connecting terminal pads 44 securedly fixed to the frame in the case of a draw-out circuit breaker. The current transformers 40 also have a rating adapted to the circuit breaker rating.

According to the invention standard elements of state-of-the-art circuit breakers can be used to form, in a standard-sized molded case, a circuit breaker with a higher rating than that of the individual poles which make it up.

Figure 4:
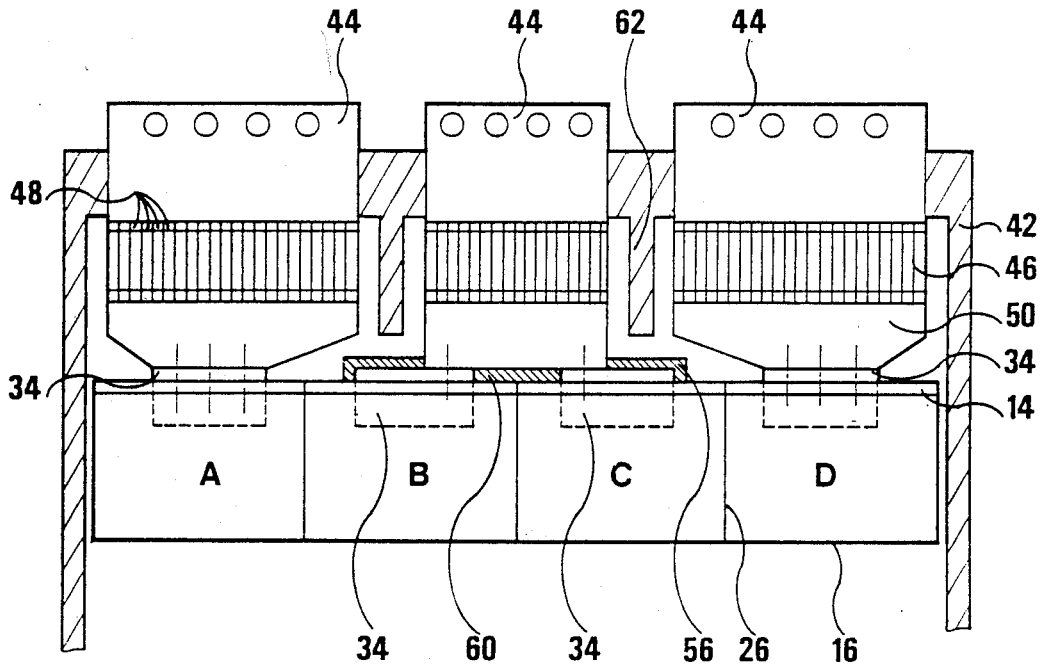
FIG. 4 is a partial schematic top view, representing the connecting parts between the connecting terminal pads protruding outwards from the rear face of a circuit breaker with twinned poles according to the invention and stationary connecting terminal pads securedly fixed to a frame, in cross-section, into which the circuit breaker is drawn.
Figure 5:
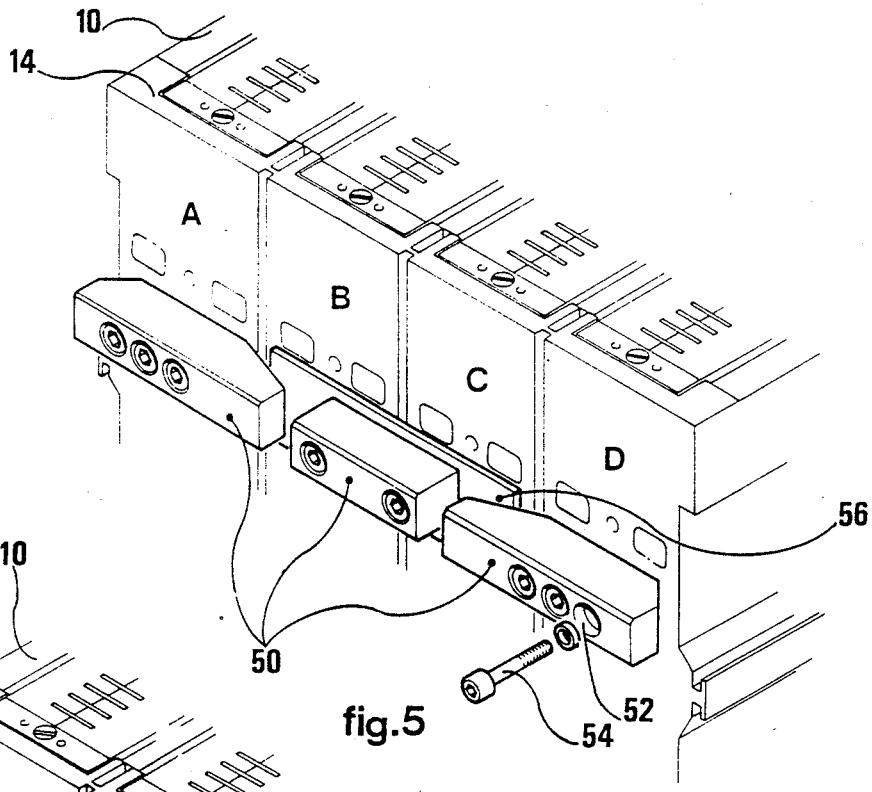
FIGS. 5 and 6 represent, in rear perspective view, the upper part of two embodiments of a circuit breaker with twinned poles according to the invention.

As a non-restrictive example, FIGS. 4 and 5 illustrate respectively a partial bottom view and a partial rear view of a three-pole circuit breaker of 4000A rating formed by a standard four-pole molded case in which four standard individual poles A, B, C and D of 3200A rating are mounted. In FIG. 4, the circuit breaker is represented in the drawn-in position in a frame 42.

The two adjacent center poles B and C are twinned, that is to say electrically fitted in parallel, to form one of the poles of the three-pole circuit breaker of higher rating, the two lateral poles A and D respectively constituting the two other poles of the three-pole circuit breaker.

The contact terminal strips 34, 38, of the different poles are fixed to connecting strips 50 designed to engage on the connecting grips 46, themselves connected to the fixed connecting terminal pads 44, when the circuit breaker is drawn into its frame 42.

In a state-of-the-art manner, a connecting strip 50 is fixed to each contact terminal pad 34, 38 of a lateral pole. Each contact terminal pad comprises tapped holes, only the axes of which are represented in FIG. 4, opening onto its rear face and facing orifices 52 passing through the associated strip so as to enable the strip to be fixed to the contact terminal pad by means of screws 54.

The connecting strips 50 associated with the lateral poles A and D are of flared shape from front to rear, so that their front face, in contact with the corresponding contact terminal pad 34, 38, having the same width as this pad, the whole strip is of greater width than the latter, the rear part of the strip extending laterally beyond the corresponding pole, A or D, in the direction of the adjacent pole, B or C.

The center connecting strip 50 is common to the twinned center poles B and C and therefore fixed to the contact terminal pads 34 of these two poles. This center strip is narrower than the previous ones and may be parallelipipedic as represented in the figures. It only covers a part of the associated contact terminal pads.

On the rear face of the circuit breaker, the space is thus divided into three connection zones, the two lateral connection zones having a greater width than that of the associated pole, A or D, and the center connection zone having a smaller width than the sum of the widths of the two associated twinned poles, B and C, and preferably smaller than the width of the lateral connection zones. A lateral connection zone thus partially overlaps the adjacent center pole.

An insulating shield 56, made of plastic material, covers the parts of the contact terminal pads of the twinned poles, B and C, which are not in contact with the associated strip 50, so as to provide insulation between the exposed parts of the contact terminal pads and the connecting strips 50 of the adjacent poles which extend into the zone located facing the center poles B and C.

Figure 7:
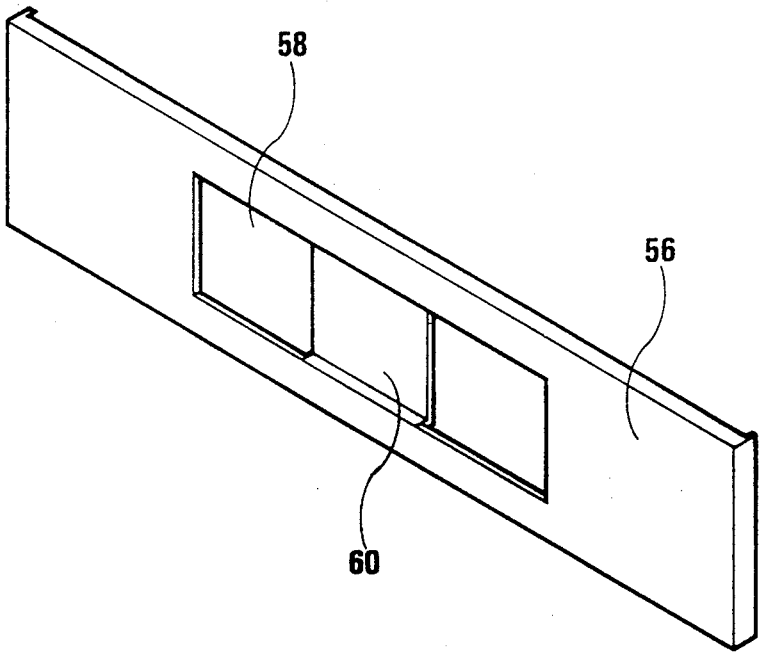
FIG. 7 represents, in perspective, an insulating part belonging to the connecting parts represented in FIGS. 4, 5 and 6.

According to a preferred embodiment, represented in FIG. 7, the insulating shield 56 comprises an orifice 58 to insert the connecting strip 50, a center part 60, whose rear face is located appreciably in the plane of the front face of the rest of the insulating shield 56, acting to secure the shield when the connecting strip is fixed onto the contact terminal pads of the twinned poles. This center part 60 is indeed then held in place, at the front by the rear face of the rear case 14, and at the rear by the center part of the strip 50 which is not in contact with the contact terminal pads, and laterally by the side walls of the contact terminal pads of the twinned poles, arranged face to face.

In each connection zone, the connecting grip 46 and the connecting terminal pad 44 associated with a connecting strip 50 have a width corresponding to the largest width of the latter.

Thus, for the lateral connection zones, the connecting grips and terminal pads are wider than the associated pole, A or D, overlapping laterally in the direction of the adjacent center pole, B or C. The frame 42 comprises insulating walls 62, perpendicular to its rear face, laterally bounding the connection zones when the circuit breaker is in the drawn-in position, and defining a minimum insulation distance between phases. To give a non-restrictive example, for a three-pole circuit breaker of 4000A rating, made up from a four-pole case comprising four standard poles of 3200A rating, the center connecting grip 46, associated with the twinned poles is a standard grip, comprising 56 contact fingers 48, adapted to a 3200A rating, whereas the lateral connecting grips each comprise 96 contact fingers.

Thus, in each of the parts associated with a circuit breaker phase of higher rating, one of the components is oversized. For the phase corresponding to the twinned poles, the contact terminal pads, formed by fitting two contact pads in parallel, are oversized, whereas for the other two phases, it is the parts connecting the contact terminal pads to the phases that are oversized. An optimum temperature rise distribution is thus achieved, making it possible to use for a given rating a circuit breaker whose individual poles are designed for a lower rating than the above-mentioned rating.

Figure 8:
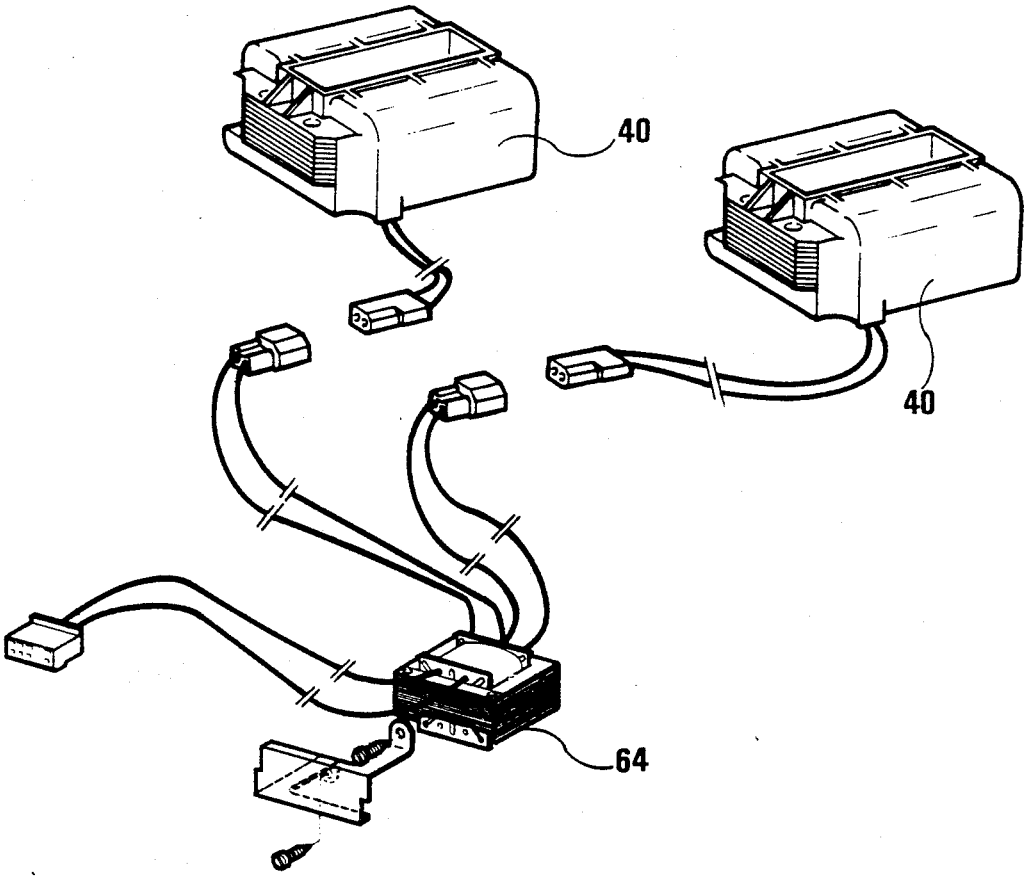
FIG. 8 illustrates a current sensor assembly used in a circuit breaker with twinned poles according to the invention.

The current transformers 40 are also adapted to the circuit breaker rating. To give an example, for a three-pole circuit breaker with a rating of 4000A, represented in FIGS. 4 and 5, the current transformers of the lateral poles A and D are each designed for a rated current of 4000A. Each of the current transformers 40 of the twinned poles, B and C, is however designed for a rated current corresponding to half the circuit breaker rating, i.e. 2000A, a summing transformer 64 (FIG. 8) receiving the output signals from the two transformers and supplying the trip device with the sum of these signals.

In a preferred embodiment, a stepdown transformer is fitted between each of the current transformers and the trip device, the summing transformer 64 also acting as a stepdown for the two current transformers of the twinned poles. Whereas the output signals from the current transformers are in the order of 1A, the output signals from the stepdown transformers applied to the trip device are in the order of 100mA. The stepdown transformers and the stepdown-summing transformer are preferably housed in the front compartment 18, in recesses 66 provided in the front face 16 of the intermediate case 10 (FIGS. 1 and 2).

The present invention is quite naturally in no way limited to the use of a four-pole case to form a three-pole circuit breaker of a higher rating.

Figure 6:
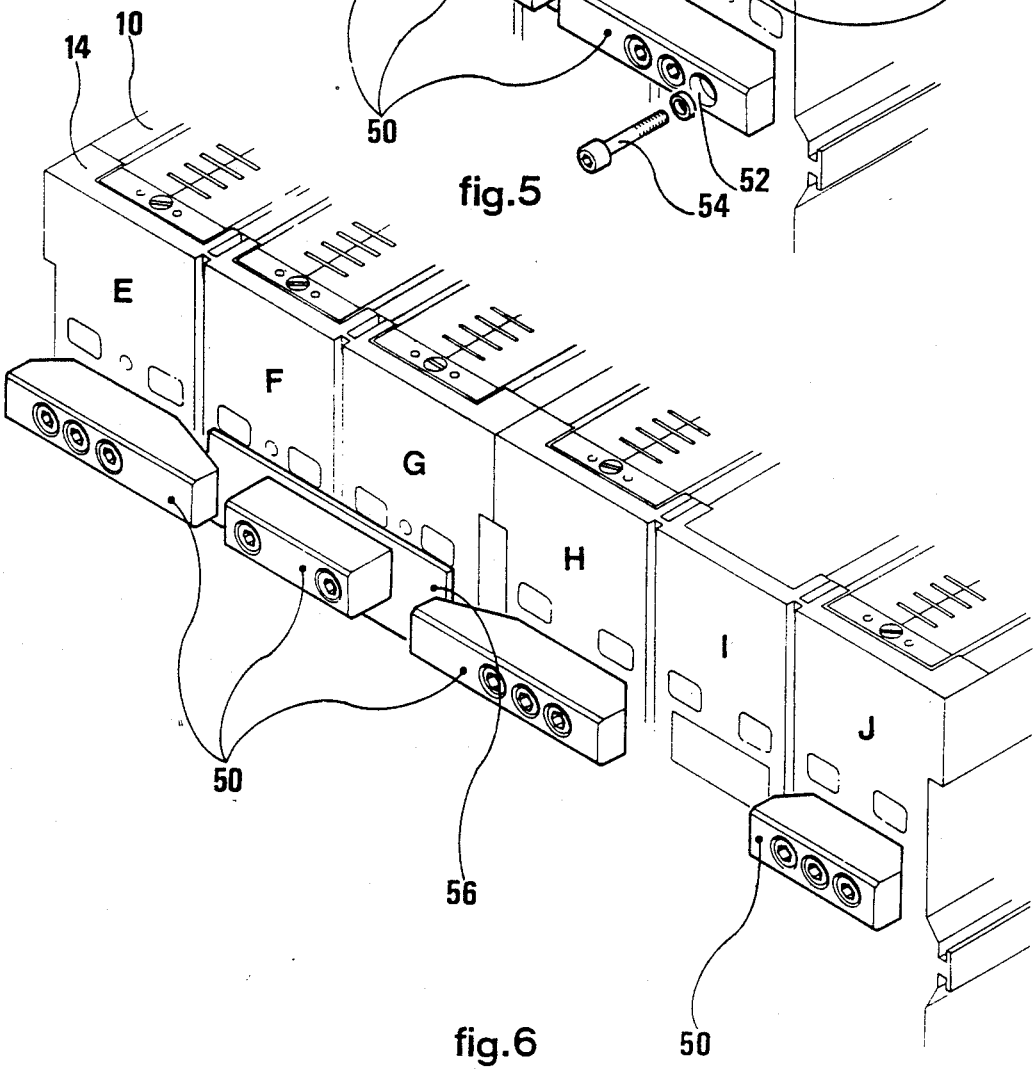

As a non-restrictive example, FIG. 6 represents a four-pole circuit breaker made up from two adjoined three-pole cases. The pole axis (not represented) is extended so as to be common to all the poles and the trip device (not represented) is common to the two cases. A particular embodiment of a case formed by adjoining two cases is described in French Patent application 8,717,447 filed on December 10th 1987. The circuit breaker represented in FIG. 6 is made up from six elementary compartments E,F,G,H,I and J. As in the embodiment in FIG. 5, the three mains phases are respectively associated with a first lateral pole E with a widened connecting strip 50, with two twinned poles F and G, and with a second pole H with a widened connecting strip 50. As for the neutral, it is associated with the other lateral pole J and separated from the other poles by an unused elementary compartment I. Each of the poles E,F,G,H and J being designed for a 3200A rating, a four-pole circuit breaker with a 4000A rating can thus be achieved. As the current normally flowing in the neutral is lower than that flowing in the other mains phases, it is not necessary to provide a widened connecting zone for the neutral. However, for insulation purposes, it is preferable to separate the pole associated with the neutral from the other poles and to fit the unused elementary compartment I between them. Similarly, by adjoining two four-pole cases comprising eight elementary compartments K,L,M,N,O,P,Q,R designed to house seven individual standard poles each designed for a 3200A rating, it is possible to achieve, according to the invention, a three-pole circuit breaker with an 8000A rating (not represented). To accomplish this, two adjacent lateral poles K and L are twinned and comprise a widened connecting strip, that is to say whose width is greater than the width of the two twinned poles. The same is the case for the two opposite adjacent lateral poles Q and R. Three of the center poles, for instance M, N and O, are connected in parallel, the elementary compartment P remaining unused. The rating of this circuit breaker is then higher than the rating of two parallel-mounted standard poles.

We claim:

1. A low-voltage multipole circuit breaker, for high current intensities, comprising a plurality of poles juxtaposed inside an insulating molded case, each pole comprising a pair of separable contacts, an arc chute, a pair of contact terminal pads connected to the separable contacts and protruding outwards from the case, and a current transformer disposed around one of the contact terminal pads and whose output is connected to a trip device common to the different poles, each pair of contact terminal pads being connected to a pair of connecting strips designed to be connected to a phase of a mains system to be protected, wherein each connecting strip of at least one of the pairs of connecting strips designed to be connected to one of the main phases, is connected to at least two adjacent twinned poles, electrically arranged in parallel, each connecting strip of at least one of the pairs of connecting strips associated with another pole of the circuit breaker having a width such that it extends laterally beyond said pole and partially overlaps the immediately adjacent pole, so that the circuit breaker can be used for a higher rating than that of the individual standard poles which make it up.

2. The circuit breaker according to claim 1, wherein the connecting strips extending laterally beyond the associated pole are of flared shape, their smallest face being in contact with the rear face of the associated contact terminal pad.

3. The circuit breaker according to claim 1, wherein each connecting strip associated with the twinned poles only covers a part of the associated contact terminal pads, an insulating shield being fitted on the free part of the contact terminal pad of the twinned poles in such a way as to provide insulation between said terminal pads and adjacent connecting strips.

4. The circuit breaker according to claim 1, wherein, the circuit breaker being of the draw-in type in a fixed frame supporting fixed connecting terminal pads designed to be connected by means of connecting grips to the circuit breaker connecting strips, the width of the fixed terminal pads and of the connecting grips is appreciably equal to that of the corresponding strip, so as to form connecting zones at least one of which is wider than the associated pole and at least one of which, associated with the twinned poles, has a smaller width than the previously mentioned one.

5. The circuit breaker according to claim 1, wherein the outputs of the current transformers of the twinned poles are connected to the input of a summing transformer whose output is applied to the trip device.

6. The circuit breaker according to claim 1, wherein it comprises four standard poles juxtaposed in a single case, the two center poles being twinned and the connecting strips of the two lateral poles laterally overlapping in the direction of the center poles, so as to form a three-pole circuit breaker of a higher rating than the rating of each of its individual poles.

7. The circuit breaker according to claim 6, wherein the four poles being standard poles of 3200A rating, the circuit breaker is a three-pole circuit breaker of 4000A rating.

8. The circuit breaker according to claim 1, comprising six elementary compartments juxtaposed in a single case and designed to house standard poles, two of the center poles being twinned and the connecting strips of the poles adjacent to the twinned poles laterally overlapping in the direction of these poles, one of the elementary compartments being unused, so as to form a four-pole circuit breaker of a higher rating than the rating of each of its individual poles.

9. The circuit breaker according to claim 1, comprising eight elementary compartments juxtaposed in a single case and designed to house standard poles, the end poles being twinned two by two and associated with connecting strips laterally overlapping in the direction of the adjacent poles, three of the center poles being twinned and one of the elementary compartments remaining unused, so as to form a three-pole circuit breaker of a higher rating than the rating of two of its individual poles mounted in parallel.

10. The circuit breaker according to claim 8, formed by adjoining two three-pole or four-pole circuit molded case circuit breakers whose pole operating axis is common and comprising a common trip device.

* * * * *